US005249688A

United States Patent [19]

Hwang

[11] Patent Number: 5,249,688

[45] Date of Patent: Oct. 5, 1993

[54] FROTH FLOTATION APPARATUS

[75] Inventor: Jiann-Yang Hwang, Houghton, Mich.

[73] Assignee: Board of Control of Michigan Technological University, Houghton, Mich.

[21] Appl. No.: 868,085

[22] Filed: Sep. 23, 1991

Related U.S. Application Data

[62] Division of Ser. No. 491,724, Mar. 12, 1990, Pat. No. 5,096,572.

[51] Int. Cl.[5] ..... B03D 1/14; B03D 1/24

[52] U.S. Cl. ..... 209/170; 209/168; 209/169; 261/123; 210/221.2

[58] Field of Search ..... 209/168, 169, 170; 261/123; 210/221.2

[56] References Cited

U.S. PATENT DOCUMENTS

| | | | |
|---|---|---|---|
| 1,240,824 | 9/1917 | Clawson | 209/170 |
| 1,952,727 | 3/1934 | Ralston | 209/170 |
| 2,778,499 | 1/1957 | Chamberlain | 209/170 |
| 3,339,730 | 9/1967 | Boutin | 209/170 |
| 3,371,779 | 3/1968 | Hollingsworth | 209/166 |
| 3,462,617 | 2/1972 | Brink | 209/170 |
| 3,747,757 | 7/1973 | Kalthoff | 209/170 |
| 3,959,131 | 5/1976 | Ramirez | 209/170 |
| 4,031,006 | 6/1977 | Ramirez | 209/170 |
| 4,161,444 | 7/1979 | Moore | 209/169 |
| 4,186,094 | 1/1980 | Hellberg | 209/170 |
| 4,214,982 | 7/1980 | Pfalzer | 209/170 |
| 4,399,028 | 8/1983 | Kile | 209/170 |
| 4,448,681 | 5/1984 | Ludke | 209/170 |
| 4,512,888 | 4/1985 | Flynn | 209/170 |
| 4,534,862 | 8/1985 | Zlokarnik | 209/170 |
| 4,548,673 | 10/1985 | Nanda | 209/170 |
| 4,592,834 | 6/1986 | Yang | 209/170 |
| 4,620,926 | 11/1986 | Linck | 209/170 |
| 4,721,562 | 1/1988 | Barnscheidt | 209/170 |
| 4,750,994 | 6/1988 | Schneider | 209/170 |
| 4,752,383 | 6/1988 | McKay | 209/170 |
| 4,861,165 | 8/1989 | Fredriksson | 209/170 |
| 4,981,582 | 1/1991 | Yoon | 209/170 |
| 5,096,572 | 3/1992 | Hwang | 209/170 |
| 5,167,798 | 12/1992 | Yoon | 209/170 |

FOREIGN PATENT DOCUMENTS

| | | | |
|---|---|---|---|
| 1053388 | 4/1979 | Canada | 209/170 |
| 3312070 | 10/1984 | Fed. Rep. of Germany | 209/170 |
| 122980 | 10/1978 | Japan | 209/169 |
| 7015 | 8/1989 | World Int. Prop. O. | 209/170 |

OTHER PUBLICATIONS

"Flotation Machines" Mining Magazine Jan. 1982 pp. 35-59 by Peter Young.

*Primary Examiner*—Thomas M. Lithgow
*Attorney, Agent, or Firm*—Michael, Best & Friedrich

[57] ABSTRACT

The froth flotation apparatus includes a gas bubble-particle contact unit including a mixing structure for breaking a gas into fine bubbles,such as a packed tower packing or mechanical agitator, and a separate phase separation unit. A conditioned aqueous pulp containing a mixture of hydrophobic and hydrophilic particles and a substantially inert gas, such as air, are introduced into and combined in one end of the contact unit and subsequently flow concurrently through the mixing structure, such that the gas is broken into fine bubbles which intimately contact and become attached to the hydrophobic particles. The resulting gas bubble-particle mixture is introduced into the phase separation unit which is operated under substantially quiescent conditions. A concentrate fraction containing primarily hydrophobic particles and a tailing containing primarily hydrophilic particles are discharged from the upper and lower portions of the phase separation unit, respectively. In one embodiment, the phase separation unit comprises a vertical column including one or more slowly rotating paddles in the froth zone to produce a froth having a substantially uniform buoyancy. In another embodiment, the phase separation unit comprises an elongated, generally horizontal tank and includes a skimming assembly for moving froth toward the concentrate fraction outlet.

10 Claims, 2 Drawing Sheets

FROTH FLOTATION APPARATUS

This is a division of application Ser. No. 491,724, filed Mar. 12, 1990. (now U.S. Pat. No. 5,096,572).

BACKGROUND OF THE INVENTION

This invention relates to froth flotation and, more particularly, to froth flotation apparatus and methods for beneficiating mineral ores, coal and the like.

Froth flotation has been used to beneficiate a variety of mineral ores and to effect separation of a wide variety of materials for many years. Froth flotation involves separation of particles in an aqueous pulp based on a difference in hydrophobicity. The pulp is aerated by contacting with fine air bubbles. The hydrophobic particles attach to the air bubbles and rise to and float on the surface of the pulp as a froth, leaving behind the hydrophilic particles.

An article entitled "Flotation Machines" in *Mining Magazine,* January 1982, page 35, describes several different types of conventional flotation apparatus and methods for beneficiating minerals. In so-called column flotation, a conditioned pulp is introduced into the middle of the column, pressurized air is introduced into the bottom and wash water is introduced into the top. A flotation fraction containing the hydrophobic particles, usually the mineral values, overflows from the top of the column and a tailing fraction containing the hydrophilic particles, usually the gangue, is discharged from the bottom of the column by gravity or a pump. Examples of prior column flotation apparatus are disclosed in Hollingsworth, et al. U.S. Pat. No. 3,371,779, Yang U.S. Pat. No. 4,592,834 and the references cited therein.

Conventional froth flotation devices and methods typically employ a single unit for aerating the pulp and for effecting separation of the froth. Many require mechanical mixing and, therefore, are energy inefficient. Optimum phase separation requires substantially quiescent conditions, while optimum mixing of gas bubbles into a pulp requires a turbulence with a minimum relative flow velocity between the bubbles and the particles in the pulp. The overall efficiency of single unit devices is inherently limited because it is difficult to optimize the turbulent and quiescent conditions simultaneously in a single unit.

SUMMARY OF THE INVENTION

An object of the invention is to provide an apparatus and method for effectively separating hydrophobic particles from an aqueous pulp containing a mixture of hydrophobic and hydrophilic particles.

Another object of the invention is to provide such an apparatus and method in which the gas bubbles and pulp are contacted by concurrent flow in a unit or zone physically separated from the phase separation unit or zone.

A further object of the invention is to provide such an apparatus and method which produces a high gas bubble-to-particle contact without mechanical agitation means.

Other objects, aspects and advantages of the invention will become apparent to those skilled in the art upon reviewing the following detailed description, the drawings and the appended claims.

The invention provides froth flotation apparatus for concentrating hydrophobic particles in an aqueous pulp containing a mixture of hydrophobic and hydrophilic particles, which apparatus includes a gas bubble-particle contact unit and a separate phase separation unit. The contact unit includes a container, mixing means disposed in the container for breaking the gas into fine bubbles, means for introducing an aqueous pulp into the inlet end of the container for flow through the mixing means and means for introducing a gas into the inlet end of the container for flow through the means, concurrently with the flow of the pulp, such that the gas is broken into fine bubbles which intimately contact and become attached to the hydrophobic particles to produce an aqueous mixture containing gas bubbles carrying hydrophobic particles. The phase separation unit includes a vessel which receives the gas bubble-particle mixture from the contact unit and is adapted to permit the hydrophobic particle-carrying bubbles in the mixture to rise to the surface. A concentrate fraction containing hydrophobic particles in the aqueous pulp is discharged from the upper portion of the vessel and a tailing fraction containing hydrophilic particles is discharged from the lower portion of the vessel.

The mixing means in the contact unit can be a static diffuser, such as a packed tower packing, or mechanical agitation means.

In one embodiment, the phase separation unit comprises a vertical column including a froth zone having an outlet through which the concentrate fraction is discharged from the upper portion of the column, an outlet through which the tailing fraction is discharged from the lower portion of the column and an inlet interposed the froth zone and the tailing outlet through which the mixture from the contact unit is introduced into the column. Means for gently stirring the hydrophobic particle-carrying bubbles collecting in the froth zone can be provided to produce a froth having a substantially uniform buoyancy.

In another embodiment, the phase separation unit comprises an elongated, generally horizontal tank having an inlet end in which the mixture from the contact zone is introduced, an outlet end including an upper outlet through which the concentrate fraction is discharged and a lower outlet through which the tailing fraction is discharged, a top portion located above the inlet, defining a froth zone communicating with the concentrate fraction outlet and extending substantially along the length of the tank, and skimming means in the froth zone for moving the froth toward the concentrate fraction outlet.

DESCRIPTION OF THE PREFERRED EMBODIMENTS

The apparatus and method of the invention can be used to separate a wide variety of materials in a broad range of particle sizes. Both are particularly adaptable for beneficiating minerals such as mineral ores, coal and the like and will be described in connection with that application.

Figure 1:
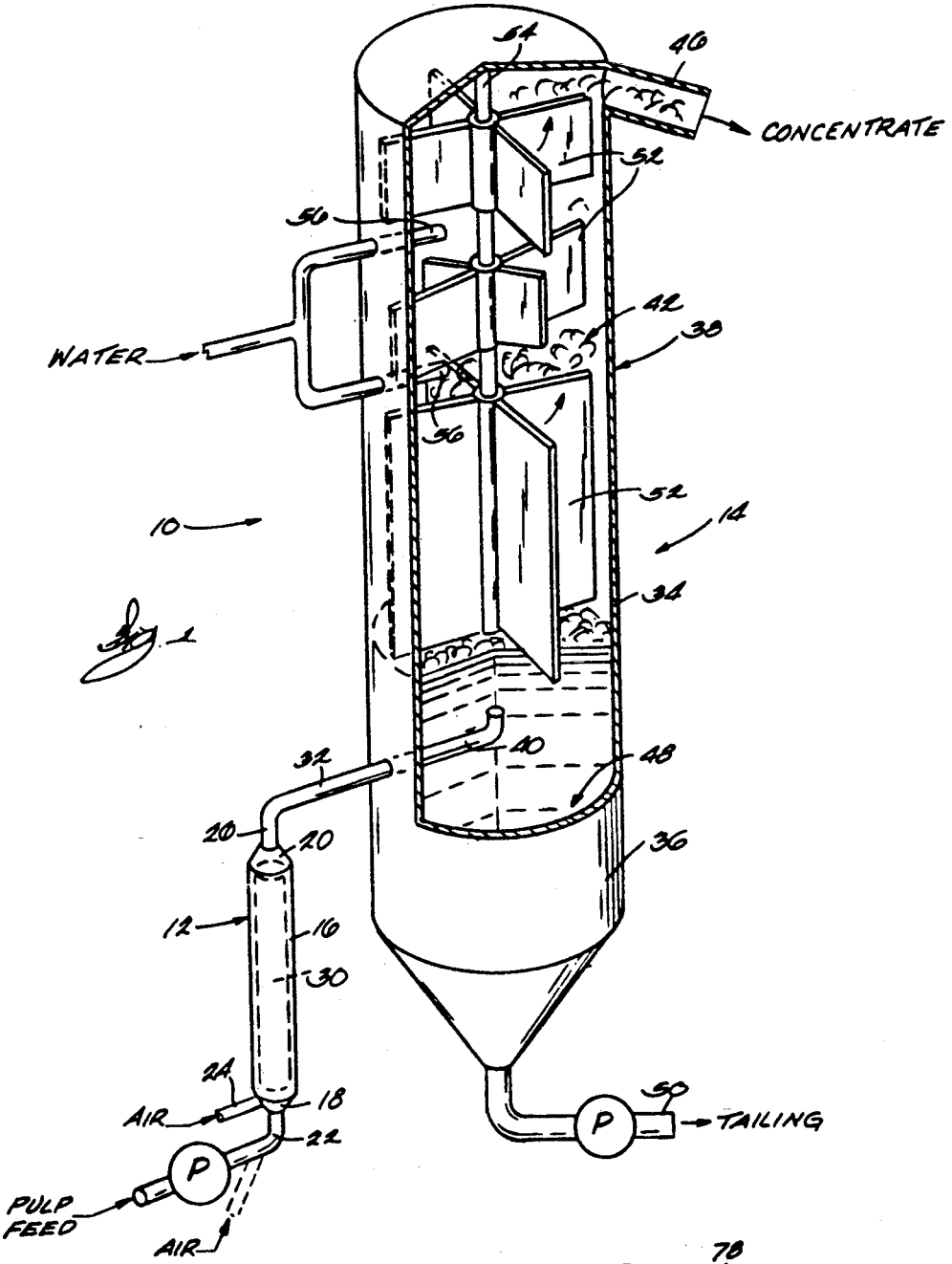
FIG. 1 is a partially diagrammatic and partially sectioned perspective representation of froth flotation apparatus embodying the invention.

Referring to FIG. 1, the flotation apparatus 10 of the invention includes a gas bubble-particle contact unit 12 and a separate phase separation unit 14. The gas bubble-particle contact unit 12 includes a tubular column 16 having a lower portion 18 and an upper portion 20, a pulp inlet 22 for introducing a conditioned, aqueous slurry or pulp of a finely-divided mineral or coal into the lower portion 18 of the column, a gas inlet 24 for introducing a substantially inert gas, such as air, into the lower portion 18 of the column 16 and an outlet 26 through which a mixture containing gas bubbles and particles is discharged from the upper portion 18 of the column 16. While the column 16 is vertical in the illustrated embodiment, it can be at other orientations and even horizontal if desired.

Disposed in the column 16 between the lower and upper portions 18 and 20 is a mixing means for breaking air into small bubbles. The mixing means preferably is a static diffuser means which breaks air into fine bubbles by shearing, thereby reducing energy requirements and enhancing councurrent flow of hydrophobic particles in the pulp and air bubbles. In the specific embodiment illustrated in FIG. 1, the static diffuser means is a packed tower packing 30 which fills an intermediate zone between the lower and upper portions 18 and 20 of the column 16 and defines a large number of small flow passages extending in a circuitous or tortuous pattern between the lower and upper portions 18 and 20.

The packing 30 can be in any of a variety of forms capable of providing a large number of flow passages extending in a circuitous or tortuous pattern between the lower and upper portions 18 and 20 of the column 16. Suitable packing includes conventional packing materials used in packed towers for vapor-liquid transfer operations, such as Raschig rings, Berl saddles, partition rings and the like. Also, a corrugated plate-like packing like that disclosed in Yang U.S. Pat. No. 4,592,834 and conventional static mixers including a large number of flow passages can be used.

The aqueous pulp is pumped or otherwise introduced into the column 16 under pressure and air is introduced so that both flow concurrently through the flow passages defined by the packing 30 at a relatively high velocity or throughput. The resulting turbulent conditions causes the air to be sheared into smaller bubbles. The large number of fine bubbles increases the number of collisions between the air bubbles and the particles in the pulp and also increases the surface area available for contact with the particles.

When relatively large amounts of air are required to obtain the desired separation, pressurized air is introduced into the column 16 through the gas inlet 24. When smaller amounts of air are sufficient and the velocity of the pulp flow is relatively high, air can be introduced into the column 16 along with the pulp. For example, air at ambient pressure can be drawn into a conduit leading to the pulp inlet 22 by the aspirating effect of pulp flow (as illustrated by dashed lines in FIG. 1).

The probability of the hydrophobic particles attaching to air bubbles depends to some extent on the relative flow velocity of the bubbles and the particles. If the relative flow velocity is too high, the particles tend to follow the flow trajectory of the pulp and pass by the sides of the bubbles, rather than attaching to the bubbles. Since the air bubbles and the hydrophobic particles flow concurrently through the f low passages defined by the packing 30, the relative velocity can be quite low. The combined effect of the turbulent conditions and the low relative velocity can produce a more efficient attachment of the hydrophobic particles to the air bubbles, even at relatively high throughputs. Conventional column flotation devices typically employ countercurrent flow between the air bubbles and pulp and, therefore, are limited with respect to the throughput because the relative velocity of the air bubbles and hydrophobic particles can become too high for an efficient attachment.

The air bubble-particle mixture produced in the contact unit 12 is transferred via a conduit means 32 to the phase separation unit 14 in which substantially quiescent conditions are maintained to enhance the phase separation effected by the air bubbles carrying hydrophobic particles rising toward and floating on the surface. In the embodiment disclosed in FIG. 1, the phase separation unit 14 includes a tubular column 34 having a lower portion 36, an upper portion 38 and an inlet 40 for introducing the air bubble-particle mixture from the contact unit 12 into the column 34 at an intermediate location. Bubbles in this mixture rise to the surface and collect in a froth zone 42 in the upper portion 38 of the column 34 to form a froth or concentrate fraction containing primarily hydrophobic particles and a minor amount of entrapped hydrophilic particles. The concentrate fraction is discharged from the froth zone 42 by overflowing through an outlet 46 in the upper portion 36 of the column 34.

A tailing fraction containing hydrophilic particles and a minor amount of hydrophobic particles collects in a tailing zone 48 in the lower portion 36 of the column 34. The tailing fraction is pumped or otherwise discharged from the column 34 through an outlet 50.

The bubbles rising through the mixture can rise faster at the center and become thickened near the wall of the column 34. This can be alleviated by providing means in the froth zone 42 for gently stirring the froth so that it has a substantially uniform buoyancy. In the specific embodiment illustrated in FIG. 1, such stirring means includes a plurality of vertically spaced, radially extending paddles 52 mounted on a vertical shaft 54 which is slowly rotated by a suitable drive means (not shown). The paddles 52 also assist in moving the froth toward the outlet 46.

Water or another suitable wash liquid is introduced into the froth zone 42 through spray nozzles 56 or the like to remove hydrophilic particles entrapped in the froth and to improve the fluidity of the froth. The column 34 can be empty except for the paddles 52 and the wash water nozzles 56.

In a typical operation, a mineral ore, coal or the like is comminuted into a particle size suitable for froth flotation. An aqueous slurry or pulp of this material is conditioned for froth flotation by admixing with suitable flotation reagents. For example, if coal is to be floated, a suitable collector, such as fuel oil, and a conventional frothing agent (if required), is added to and thoroughly mixed with the pulp in a conditioning vessel (not shown). Following conditioning, the aqueous pulp is pumped into the lower portion 18 of the contact unit column 16 and air is simultaneously introduced into the lower portion of the column. The flow rates of the pulp and the air can be adjusted to obtain the desired throughput and the maximum attachment of the hydrophobic particles of coal to air bubbles. The resulting aerated pulp is transferred from the contact unit 12 via conduit means 32 and introduced into the phase separation unit 14. The input rate of the mixture, discharge rates of the concentrate and tailing fractions and flow rate of wash water can be adjusted to provide the most efficient separation of hydrophobic particles from the mixture in the phase separation unit 14.

Figure 2:
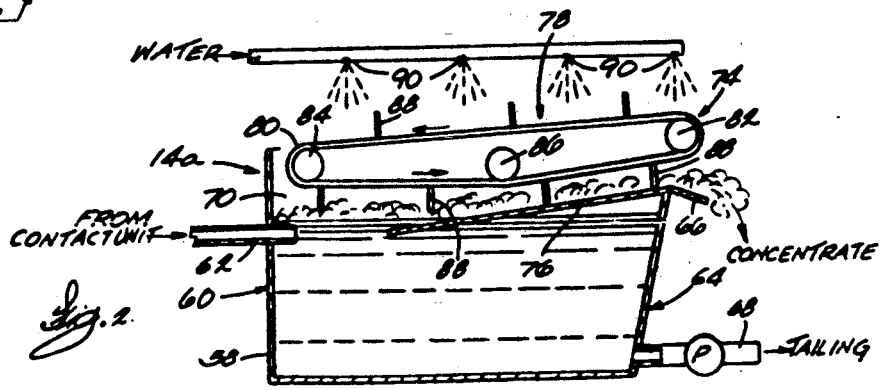
FIG. 2 is a diagrammatic representation of an alternate arrangement for the phase separating unit of flotation apparatus embodying the invention.

In the alternate embodiment illustrated in FIG. 2, the phase separation unit 14*a* includes an elongated, generally horizontal tank 58 having an inlet end 60 including an inlet 62 through which the air bubble-particle mixture from the contact unit 12 is introduced into the tank 58. The tank 58 also includes an outlet end 64 including an upper outlet 66 through which the concentrate fraction overflows and a lower outlet 68 through which the tailing fraction is discharged. Bubbles in the mixture immediately rise to the surface and collect as a froth or concentrate fraction in a froth zone 70 located in the top portion of the tank 58. The froth zone 70 extends along the length of the tank 58 and communicates with the upper outlet 66.

The overflow of the concentrate fraction is promoted by a skimming assembly 74 located in the froth zone 70. The skimming assembly 74 includes a grinding plate 76 located in the froth zone 70 and a froth skimmer 78 located above the grinding plate 76. The grinding plate 76 slopes gently upwardly toward the upper outlet 66, (e.g., in the order of 20° to the horizontal). The froth skimmer 78 includes a continuous, elongated conveying means 80, such as a chain or belt, trained around pulleys or gears 82 and 84 and over an idler pulley or gear 86. One of the pulleys or gears 82 and 84 is driven by a suitable drive means (not shown). The conveying means 80 carries a plurality of longitudinally spaced, laterally extending paddles 88 which extend down into the froth and cooperate with the grinding plate 76 to skim the froth and move it toward the upper outlet 66.

During skimming, a mist of water or another suitable wash liquid is sprayed onto the froth through a plurality of spray nozzels 90, located above the skimming assembly 74 and longitudinally spaced along the length of the tank 58, to remove hydrophilic particles entrapped in the froth and improve the fluidity of the froth. Thus, the phase separation unit 14*a* illustrated in FIG. 2 employs lateral froth cleaning, while the phase separation unit 14 illustrated in FIG. 1 employs vertical cleaning.

Figure 3:
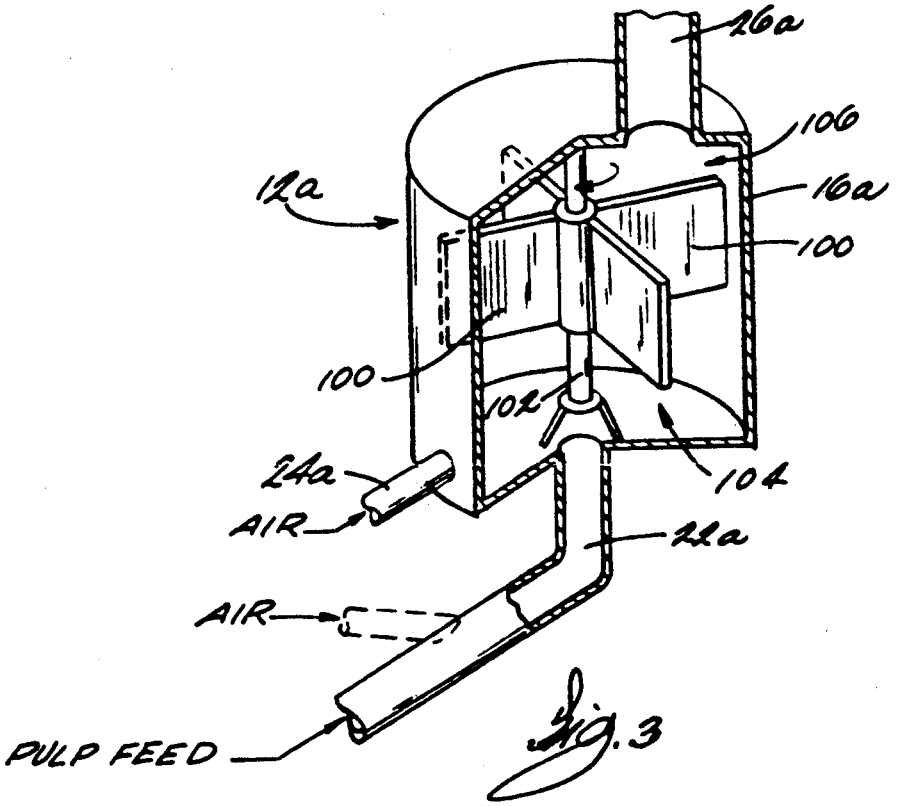
FIG. 3 is a diagrammatic representation of an alternate arrangement for the the contact unit of flotation apparatus embodying the invention.

FIG. 3 illustrates an alternate arrangement for the contact unit. The contact unit 12*a* includes a cylindrical column 16*a* and a mechanical agitation means disposed in the column 16*a* for breaking air into small bubbles. In the specific construction illustrated, the mechanical agitation means comprises a plurality of radically extending impeller blades 100 carried on a vertical shaft 102 which is rotated by suitable drive means (not shown) at a speed required to break air introduced into the column 16*a* into fine bubbles. The lower and upper edges of the impeller blades 100 preferably are respectively spaced some distance away from the bottom and top of the column 16*a* to provide an inlet zone 104 for the incoming pulp and air and an outlet zone 106 for the outgoing air bubble-particle mixture.

Such a mechanical agitation means tends to produce a less effective attachment of hydrophobic particles to the air bubbles than a static diffuser because the flow of the particles and bubbles through the column may not be concurrent in some regions. However, mechanical agitation means may be required when plugging or scaling of a static diffuser is a concern. For example, pulps containing significant amounts of relatively long fibrous materials may cause plugging of a static diffuser. A mechanical agitation means can be used in combination with a static diffuser with the mechanical agitation means located upstream and/or downstream of the static diffuser means.

The apparatus and method of this invention provides several advantages. By physically isolating the gas bubble-particle contact and phase separation functions, the operation of each can be optimized with a substantially smaller effect on the other than is the case with conventional devices in which both functions are performed in a single unit. For instance, the contact unit can be operated with a high throughput, creating more turbulence which enhances contact between the gas bubbles and hydrophobic particles. The increased turbulence has little or no effect on phase separation because the phase separation unit is physically isolated from the contact unit. The use of static diffuser means for breaking the gas into fine bubbles and mixing the bubbles with the pulp, in accordance with a preferred embodiment, reduces operating costs. Concurrent flow of the gas bubbles and particles in the contact unit in combination with the turbulence created by the mixing means can provide a more efficient attachment of gas bubbles to the hydrophobic particles. Phase separation can be enhanced because the phase separation unit does not require mixing for gas bubble-particle contact and, therefore, can be operated under substantially quiescent conditions. The combination of these and other features can result in lower construction and operating costs and improved overall efficiency.

Without further elaboration, it is believed that one skilled in the art, using the preceding description, can utilize the present invention to its fullest extent. The following examples are presented to exemplify embodiments of the invention and should not be construed as limitations thereof.

EXAMPLE 1

Coal from Pittsburgh No 8 seam containing 6.66 wt. % was processed in a laboratory setup like that illustrated in FIG. 1. The gas bubble-particle contact unit consisted of a square tube, one-half in. wide and 28 in. long, containing a corrugated plate packing as a static diffuser or mixer. The phase separation unit was a vertically oriented, cylindrical tube ¾ in. I.D. and 36 in. long and included slowly rotating paddles for gently stirring the froth. The mixture inlet was located at 26 inches below the top of the tube.

An aqueous slurry of coal particles, (85 wt. % particles passed 22 micrometers; total solid contents=5 wt. % was prepared and conditioned for flotation by admixing therewith sodium silicate, fuel oil and a frothing agent (Dowfroth 250 marketed by Dow Chemical Company). The coal slurry was introduced into the contact unit at a flow rate of 500 ml/min (equivalent to 2,000 ml/in /min). Air was introduced into the contact unit at a flow rate of 5 l/min. The gas bubble-particle mixture produced in the contact unit was fed into the separation unit and washing water was added a flow rate of 100 ml/min. After equilibrium conditions were reached, samples of the coal concentrate and tailing were collected from the top and bottom of the phase separation unit, respectively, and analyzed. The coal concentrate had an ash content of 3.28 wt. % and coal recovery was 89.8%. The tailing fraction had an ash content of 35.61 wt. % and contained of 10.2% of the coal in the starting material.

From these test results, it can be seen that the embodiment of the invention illustrated in FIG. 1 is capable of yielding excellent separation of ash from coal.

EXAMPLE 2

The coal identified in Example 1 was processed in a laboratory setup including the contact unit described in Example 1 and a phase separation unit like that illustrated in FIG. 2. The phase separation unit was in a rectangular tank, 12 in. wide, 18 in. long and 12 in. deep. A plate, 12 in. long and 12 in. wide, was situated in the top portion of the tank at a 20° slope to serve as a froth grinder and paddle was used for skimming froth from the tank.

The coal slurry was introduced into the contact unit at a flow rate of 800 ml/min (equivalent to 3200 ml/in$^2$/min). Air was introduced into the contact unit at a flow rate of 4.5 l/min. The gas bubble-particle mixture from the contact unit was fed into the phase separation tank. A water mist was sprayed into the froth zone at a flow rate of 200 ml/min. After equilibrium conditions were reached, samples of the concentrate and tailing were collected and analyzed. The concentrate had an ash content of 3.01 wt. % and the recovery of coal was 71.2%. The tailing fraction had an ash content of 15.73 wt. % and contained 28.8% of the coal in the starting material.

From these test results, it can be seen that the embodiment of the invention illustrated in FIG. 2 is capable of yielding excellent separation of ash from coal.

EXAMPLE 3

A recleaner copper sample (copper content = 12.5 wt. %) obtained from a copper processing plant was processed in the test setup described in Example 1. An aqueous slurry of the copper sample (average particle size = 12.5 micrometers; total solids = 6.75 wt. %) was prepared and conditioned in the manner described in Example 1. The copper slurry was introduced into the contact unit at a flow rate of 890 ml/min (equivalent to 3560 ml/in$^2$/min). Air was introduced into the contact unit at a flow rate of 4 l/min. Washing water was added to the phase separation unit at a flow rate of 100 ml/min. After equilibrium conditions were reached, samples of a copper concentrate and tailing were collected and analyzed. The copper concentrate had a copper content of 34.86 wt. % and the copper recovery was 83.1%. The tailing had a copper content of 3.04 wt. % and retained the 69% of solids weight.

The plant from which the copper sample was obtained employs a conventional flotation process which typically produces a concentrate having a copper content of approximately 20 wt. % and about the same degree of recovery.

From the foregoing description, one skilled in the art can easily ascertain the essential characteristics of the invention and, without departing from the spirit and scope thereof, make various modifications and changes to adapt it to various usages.

I claim:

1. An apparatus for concentrating by froth floatation hydrophobic particles in an aqueous pulp containing a mixture of hydrophobic and hydrophilic particles, said apparatus comprising a gas bubble-particle contact unit including a container comprising a generally vertical column having an inlet end and an outlet end, mixing means disposed in said container, said mixing means comprising static diffuser means which defines a large number of circuitous flow passages through which the gas and pulp flow enroute to the outlet portion of said container, for breaking a gas into fine bubbles by shearing;

means for introducing the aqueous pulp into the inlet end of said container for flow through said mixing means toward the outlet end of said container, and means for introducing a substantially inert gas into the inlet end of said container for combination with said aqueous pulp and subsequent concurrent flow therewith through said mixing means toward the outlet of said container under conditions which cause the gas to be sheared into fine bubbles and the resulting fine bubbles to be simultaneously turbulently intermixed with the aqueous pulp to collide with and become attached to the hydrophobic particles to produce an aqueous mixture containing gas bubbles carrying hydrophobic particles; and a phase separation unit physically separated from said contact unit and including a vessel for receiving the mixture from the outlet end of said container, said vessel including an upper portion and a lower portion and being adapted to permit the particle-carrying bubbles in the mixture to rise toward the upper portion of said vessel;

means for transferring the mixture from said contact unit into said vessel;

means for discharging a concentrate fraction containing primarily hydrophobic particles in the aqueous pulp from the upper portion of said vessel; and means for discharging a tailing fraction containing primarily hydrophilic particles in the aqueous pulp from the lower portion of said vessel.

2. An apparatus according to claim 1 wherein said diffuser means is packed tower packing.

3. An apparatus according to claim 1 wherein said phase separation unit vessel is a generally vertical column comprising an upper portion including a froth zone and an outlet through which the concentrate fraction is discharged from said column;

a lower portion including an outlet through which the tailing fraction is discharged from said column; and an inlet interposed said froth zone and said tailing fraction outlet through which the mixture from said contact unit is introduced into said column.

4. An apparatus according to claim 3 including means disposed in said froth zone for gently stirring the particle-carrying bubbles to produce a froth having a substantially uniform buoyancy.

5. An apparatus according to claim 3 including means for introducing a wash liquid into said froth zone to remove hydrophilic particles entrapped in the froth.

6. An apparatus according to claim 1 wherein said phase separation unit vessel is an elongated, generally horizontal tank comprising an inlet end portion including an inlet through which the mixture from said contact zone is introduced into said tank;

an outlet end portion including an upper outlet through which the concentrate fraction is discharged from said tank and a lower outlet through which the tailing fraction is discharged from said tank; and a top portion located above said mixture inlet and defining a froth zone communicating with said floatation fraction outlet and extending substantially along the length said tank wherein the particle-carrying bubbles rise to the surface and collect to form a froth 7. An apparatus according to claim 6 wherein said phase separation unit includes skimming means in said froth zone for moving the froth toward said concentrate fraction outlet.

8. An apparatus according to claim 7 including means for introducing a wash liquid into and along the length of said froth zone to remove hydrophilic particles entrapped in the froth.

9. An apparatus according to claim 8 wherein said skimming means includes a longitudinally extending froth grinding plate in said froth zone sloping upwardly in a direction toward said concentrate fraction outlet; and a froth skimmer including a longitudinally extending, endless conveying means located above said froth grinding plate and carrying a plurality of longitudinally spaced, laterally extending paddles which cooperate with said froth grinding plate to separate the froth and move it toward said concentrate fraction outlet.

10. An apparatus according to claim 9 wherein said means for introducing a wash liquid comprises a plurality of longitudinally-spaced spray nozzles located above said froth zone.

* * * * *